US006256824B1

(12) United States Patent
Austin et al.

(10) Patent No.: US 6,256,824 B1
(45) Date of Patent: Jul. 10, 2001

(54) METHOD OF MAKING A LOTTERY SHOE

(75) Inventors: Thomas Austin, Ardmore, PA (US); Tuan Le, Portland, OR (US); Chin Chu Yeh, TaiChung (TW)

(73) Assignee: Basketball Marketing Company, Inc., Paoli, PA (US)

( * ) Notice: Subject to any disclaimer, the term of this patent is extended or adjusted under 35 U.S.C. 154(b) by 0 days.

(21) Appl. No.: 09/671,872

(22) Filed: Sep. 27, 2000

Related U.S. Application Data

(62) Division of application No. 09/223,551, filed on Dec. 30, 1998, now Pat. No. 6,154,983.

(51) Int. Cl.[7] ..... A43D 11/00

(52) U.S. Cl. ..... 12/142 P; 12/142 T; 36/12; 36/14; 36/28; 36/31; 36/50.5; 36/55

(58) Field of Search ..... 12/142 T, 142 P; 36/12, 91, 14, 28, 55, 50.1, 31

(56) References Cited

U.S. PATENT DOCUMENTS

| | | | | |
|---|---|---|---|---|
| 1,637,897 | * | 8/1927 | Eddins . | |
| 2,794,270 | | 6/1957 | Dubner | 36/2.5 |
| 2,970,391 | | 2/1961 | Violano et al. | 36/17 |
| 4,505,055 | * | 3/1985 | Bergmans . | |
| 4,858,340 | | 8/1989 | Pasternak | 36/88 |
| 5,377,430 | | 1/1995 | Hatfoeld et al. | 36/51 |
| 5,381,607 | | 1/1995 | Sussmann | 36/28 |
| 5,388,349 | | 2/1995 | Ogden | 36/43 |
| 5,426,870 | | 6/1995 | Purnell et al. | 36/84 |
| 5,435,078 | | 7/1995 | Pyle | 36/30 |
| 5,469,638 | | 11/1995 | Crawford, III | 36/28 |
| 5,469,639 | | 11/1995 | Sessa | 36/28 |
| 5,575,089 | | 11/1996 | Giese et al. | 36/30 |
| 5,653,047 | | 8/1997 | Franey | 36/136 |
| 5,659,914 | * | 8/1997 | Steinlauf . | |
| 5,718,064 | | 2/1998 | Pyle | 36/28 |
| 5,724,753 | | 3/1998 | Throneburg et al. | 36/91 |
| 5,743,027 | * | 4/1998 | Barma . | |
| 5,746,012 | | 5/1998 | Caletti et al. | 36/3 B |
| 5,779,834 | * | 7/1998 | Pavelescu et al. . | |
| 5,784,808 | | 7/1998 | Hockerson | 36/102 |
| 5,784,809 | | 7/1998 | McDonald | 36/117.5 |
| 5,787,610 | | 8/1998 | Brooks | 36/28 |
| 5,797,199 | | 8/1998 | Miller et al. | 36/28 |
| 5,918,382 | * | 7/1999 | Haderlein et al. . | |

* cited by examiner

*Primary Examiner*—Ted Kavanaugh
(74) *Attorney, Agent, or Firm*—Woodcock Washburn Kurtz Mackiewicz & Norris LLP

(57) ABSTRACT

A shoe and an improved method of shoe construction comprising an upper, an insole, a midsole, and an outsole, that are coupled together to form a housing for receiving a foot, and wherein the midsole is enveloped by the bottom ends of the upper, the insole, and the outsole to provide a more secure and stable fit of the shoe to the foot. The shoe is constructed to have the midsole of the shoe enveloped by the combination of the upper, insole, and outsole. This method of shoe construction results in a shoe having an improved fit because the midsole is pulled from the top and the bottom to provide improved fit, support, stability, and cushioning characteristics.

6 Claims, 2 Drawing Sheets

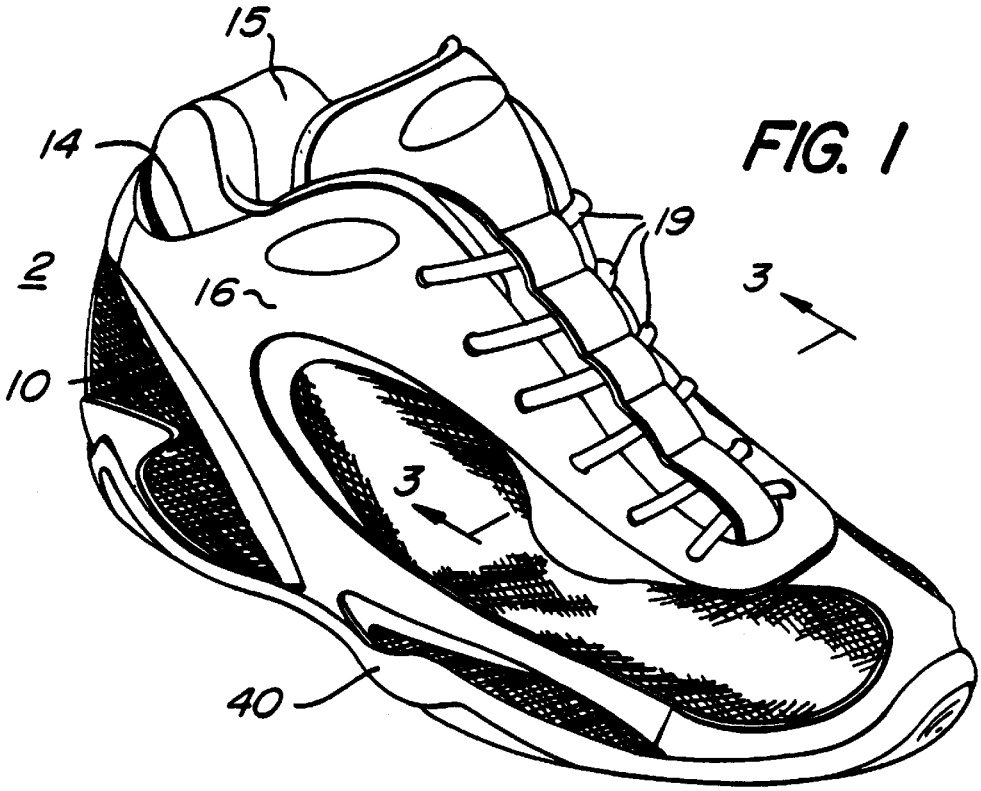
FIG. 1
FIG. 3
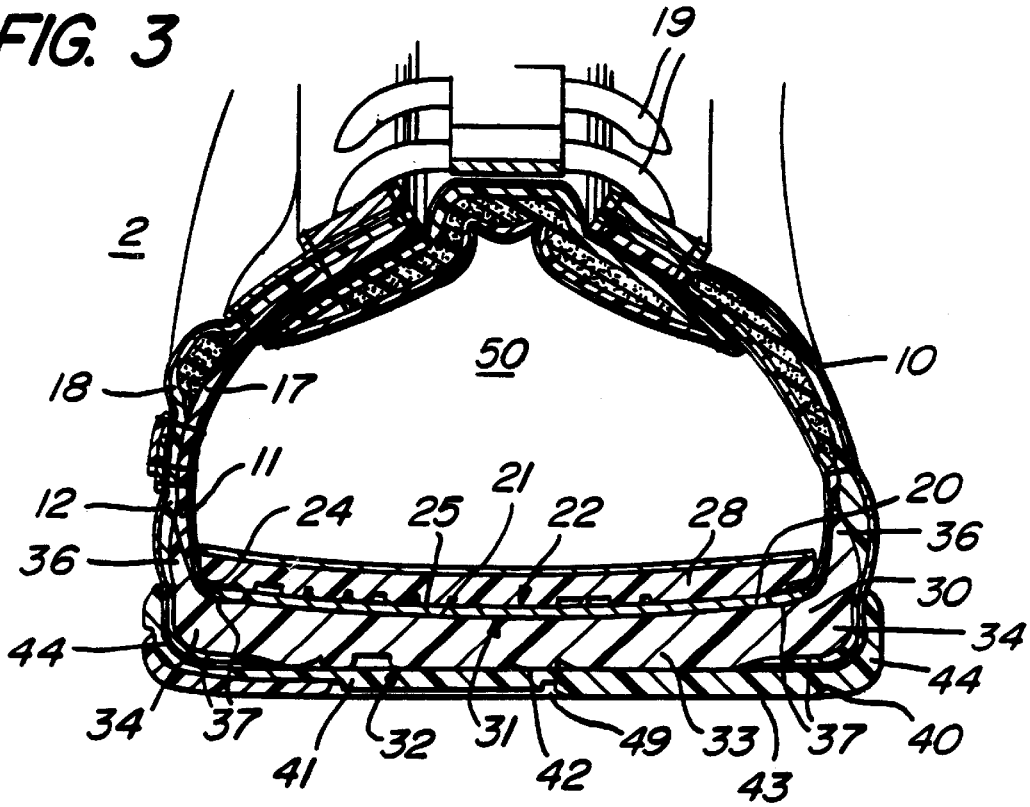

METHOD OF MAKING A LOTTERY SHOE

This application is a divisional of application Ser. No. 09/223,551 filed Dec. 30, 1998, now U.S. Pat. No. 6,154, 983.

FIELD OF THE INVENTION

The present invention relates to shoes, and more particularly, the present invention relates to an athletic shoe and to a method of shoe construction comprising an upper, an insole, a midsole, and an outsole, wherein the midsole of the shoe is enveloped by the upper, insole, and outsole of the shoe to provide improved fit, support, cushioning, and stability characteristics.

BACKGROUND OF THE INVENTION

The shoe industry is continually faced with customer demands for new and improved shoe designs. These new and improved shoe designs, especially those designed for athletics and other active wear, must be capable of securely supporting and cushioning the foot to prevent injury to the foot and leg, while at the same time providing a responsive footwear with a stable, lightweight, and streamline design. One feature of the shoe designed that has been restrained by conventional shoe manufacturing techniques is the design and integration of the midsole with the other parts of the shoe, such as the upper, insole, and outsole.

A conventional shoe comprises an upper, a midsole, an insole, and an outsole, wherein the midsole of the shoe is exposed. Prior art methods of shoe construction employ an "inside out" method which results in a portion of the midsole of the shoe being exposed. This inside out method results in a standardized look and styling employed by conventional athletic shoe brands that affect the support, responsiveness, and the streamlined look of the shoe.

The prior art method of shoe construction employing the "inside out" method resulting in the midsole of the shoe being exposed also creates problems for designers in developing a streamline and lightweight design. The design and streamline features of the shoe are interrupted by the midsole and accordingly, the upper and the outsole must be designed around the exposed midsole. This exposed midsole design also adds further variations in the shoe's interior dimensions that may affect fit, weight, and response of the footwear. In addition, the life of the shoe and the cushioning effect of the midsole is decreased with this exposed midsole design.

A shoe constructed using the prior art method has a midsole wherein the inside surface of the sidewall of the midsole was coupled to the upper and the outsole and the midsole is exposed. In accordance with this design, the laces pull the material of the shoe from the sides of the upper and top of the midsole. This results in the shoe being secured around the foot by means of a tightened upper with the midsole being loosely attached to the foot. This results in a fit that is not the best possible fit of the shoe about the foot, and also does not provide the best results with respect to the stability, support, and cushioning of the foot by the midsole.

Although the art of shoe construction is well developed, there remain some problems inherent in this technology, particularly with providing an athletic shoe and method of shoe construction that provides an improved and more secure fit of the shoe to a foot, and enhances stability, support, and cushioning of the foot by the midsole of the shoe. Therefore, the need exists for a shoe and method of shoe construction that overcomes the drawbacks of the prior art.

SUMMARY OF THE INVENTION

The present invention is directed to a shoe and an improved method of shoe construction. The shoe comprises an upper, an insole, a midsole, and an outsole, that are coupled together to form a housing for receiving a foot, and wherein the midsole is enveloped by the bottom ends of the upper, the insole, and the outsole to provide a more secure and stable fit of the shoe to the foot. The method of shoe construction comprises coupling an upper, an insole, a midsole, and an outsole together wherein the midsole of the shoe is enveloped by the combination of the upper, insole, and outsole. This method of shoe construction results in a shoe having an improved fit because the midsole is pulled from the top and bottom to provide improved fit, support, stability, and cushioning characteristics.

According to one aspect of the invention, the shoe comprises an upper, an insole coupled to the upper, a midsole coupled to the upper and the insole, and an outsole coupled to the combination of the insole, the midsole and the upper. The midsole of the shoe is enveloped by the combination of the upper, insole, and outsole, and the shoe is pulled from the bottom by a closure system to securely fit the shoe to a foot.

In accordance with an aspect of the present invention, the shoe further comprises an upper having an inner bottom end, an outer bottom end, a top end having a wraparound design forming a foot opening, an inner and an outer side wall disposed between and connecting the bottom ends and the top ends, and a closure system for coupling the shoe to a foot. An insole is coupled to the upper proximate to the inner bottom end of the upper. A midsole has a topside, a bottom side, and a peripheral edge. The inner bottom end of the upper is coupled to the topside of the midsole proximate to the peripheral edge, and the outer bottom end of the upper is coupled to the bottom side of the midsole proximate to the peripheral edge of the midsole. An outsole has a base and upwardly extending sidewalls at a peripheral edge of the base. The sidewalls have a wraparound construction about the base thereby forming a cavity. The cavity of the outsole is coupled about the combination of the upper, the insole, and the midsole. The upper, the insole, the midsole, and the outsole define a housing for receiving a foot, wherein the midsole is enveloped by the combination of the upper, the insole, and the outsole and the midsole is pulled from the bottom to fit the shoe to a foot.

In accordance with a further aspect of the present invention, the insole is coupled to the inner side panel of the upper. The side panels of the upper are then wrapped about at least a portion of the peripheral of the bottom side and the topside of the midsole. The insole is disposed over the topside of the midsole, to substantially cover the topside of the midsole. The outsole is then disposed about the bottom side of the midsole and a portion of the overlap of the outer bottom end of the upper and the midsole.

In accordance with a further aspect of the present invention, the inner bottom end of the inner side panel of the upper is coupled to the topside of the midsole and the outer bottom end of the outer side panel of the upper is coupled to the bottom side of the midsole.

In accordance with a further aspect of the present invention, the bottom ends of the upper are disposed around the topside and the bottom side of the midsole and the closure system pulls the material of the shoe from the bottom of the shoe.

In accordance with a further aspect of the present invention, the midsole further comprises upwardly extending outer peripheral support side rims having a wrap around construction. The inner bottom end of the upper is disposed around the inside of the side rims and the outer bottom end of the upper is disposed around the outside of the side rims.

In accordance with a further aspect of the present invention, the upwardly extending outer peripheral support side rims are tapered, wherein the side rims are wider at the base of the side rims than at the top.

In accordance with a further aspect of the present invention, the bottom side and the topside of the midsole have recesses formed proximate to and around the peripheral edge of the midsole and extending inwards some distance toward a middle of the midsole to accommodate the bottom ends of the upper.

In a further embodiment within the scope of the present invention, an exemplary method of shoe construction is disclosed. This method of shoe construction comprising the steps of providing an upper having an inner bottom end, an outer bottom end, a top end, and a closure system proximate the top end of the upper. Providing an insole having a substantially flat body. The body having a bottom surface, a top surface, and an outer peripheral edge. Providing a midsole having a topside, a bottom side, and a peripheral edge. Providing an outsole having a base and upwardly extending sidewalls at a peripheral edge of the base. The sidewalls having a wraparound construction about the base thereby forming a cavity. Coupling the insole to the inner bottom end of the upper. Then coupling the bottom side of the midsole to the outer bottom end and coupling the topside of the midsole to the inner bottom end of the upper. Coupling the outsole to the combination of the upper, the insole, and the midsole to form a housing. At least a portion of the peripheral of the midsole being enveloped by the bottom ends of the upper, such that the midsole is pulled from the bottom side and the topside as the closure system secures the shoe to a foot.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentalities disclosed. In the drawings:

FIG. 1 shows a perspective view of an exemplary shoe of the present invention;

FIG. 3 shows a cross sectional view of the shoe of FIG. 1, the section being taken along line 3—3 of FIG. 1.

DESCRIPTION OF EXEMPLARY EMBODIMENTS AND BEST MODE

Figure 2:
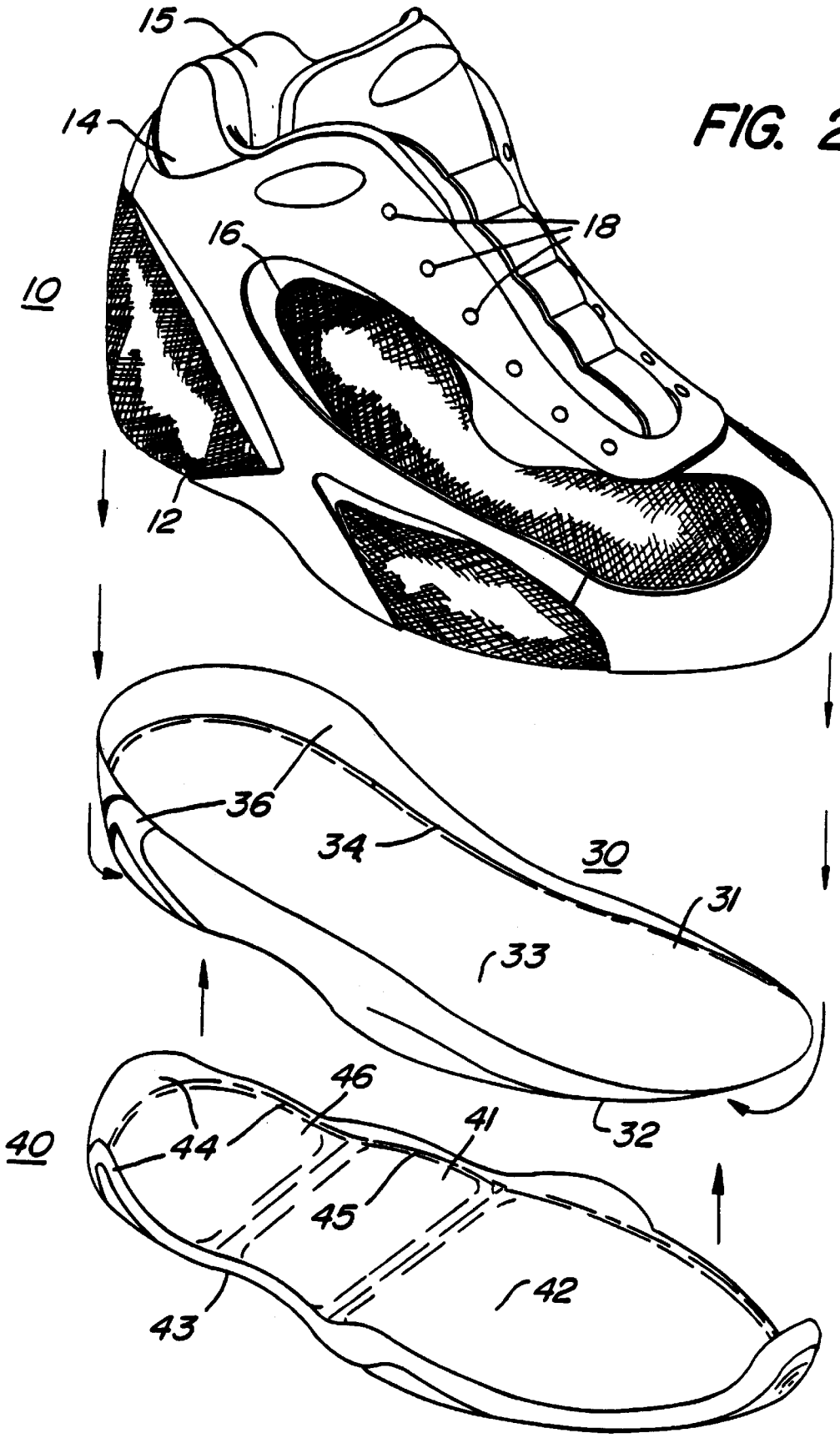
FIG. 2 shows an exploded perspective view of the shoe of FIG. 1.

A shoe and method of shoe construction that solve the above-mentioned problems in the prior art and provides other beneficial features in accordance with the presently preferred exemplary embodiment of the invention will be described below with reference to FIGS. 1–3. Those skilled in the art will readily appreciate that the description given herein with respect to those figures is for explanatory purposes only and is not intended in any way to limit the scope of the invention. Throughout the following detailed description similar reference numbers refer to similar elements in all the figures of the drawings.

The shoe preferably takes the form of an athletic shoe or sneaker, but it is contemplated that the invention is applicable to other types of shoes as well, and is not limited to the particular shoe embodiments shown. For example, the invention contemplates the use of other shoe types, other shoe structures, different methods of coupling various parts of the shoe together, and the use of various materials for the construction of the shoe.

The present invention is directed to a shoe and a method of shoe construction. The shoe of the present invention comprises an upper, an insole, a midsole, and an outsole, wherein the midsole of the shoe is enveloped by the combination of the upper, insole, and outsole. The midsole of the shoe is enveloped such that the midsole is pulled from the top and the bottom as the shoe is tightened about a foot.

The method of shoe construction of the present invention comprises the steps of providing an upper, coupling an insole to the upper, coupling a midsole to the upper, and coupling an outsole to the combination of the upper, insole, and outsole so that the midsole of the shoe is enclosed. The method of shoe construction for the shoe of the present invention basically combines two shoe structures in one. There is an inner "bootie" comprising the inner side panel of the upper and the insole. The bootie is slip lasted and fitted over a last during shoe assembly. The midsole is then coupled to this bootie and the outer side panel of the upper is coupled about at least a portion of the bottom of the midsole. Then outsole is lasted around the midsole.

FIGS. 1–3 show an exemplary shoe and an exemplary method of shoe construction to which the present invention is applicable. Referring to FIGS. 1–3, a shoe 2 is shown comprising an upper 10, an insole 20, a midsole 30, and an outsole 40. The upper 10 comprises an inner bottom end 11, an outer bottom end 12, a top end 14 having a wrap around design forming a foot opening 15, a side panel 16 having an inner side panel 17 and an outer side panel 18 that are disposed between and connect the bottom ends 11, 12 and the top ends 14, the inner side panel 17 being coupled to the outer side panel 18 proximate the top end 14, and a closure system 19 for coupling the shoe 2 to a foot (not shown).

The design of the side panel 16 of the upper 10 allows the upper 10 to be wrapped about at least a portion of the midsole 30 in such a way so that the midsole 30 is pulled from the top and bottom as the closure system 19 tightens the shoe 2 about a foot. Preferably, the inner side panel 17 is coupled to the outer side panel 18 so that the two panels are held constant relative to one another during assembly of the shoe. More preferably, the inner side panel 17 is stitched to the outer side panel 18 at the top end 14 of the upper 10 proximate the foot opening 15.

The inner side panel 17 has the inner bottom end 11 formed at the bottom of the upper 10 opposite the top end 14. The inside surface of the inner bottom end 11 is coupled to the bottom surface 21 of the insole 20, and the outside surface of the inner bottom end 11 is coupled to the topside 31 of the midsole 30. The inside surface is defined by the side or surface closest to the inside center of the shoe housing 50, and the outside surface is defined by the side or surface furthest from the inside center of the shoe housing 50. The inner bottom end 11 of upper 10 may be connected over the entire area of the interface between the insole 20 and the midsole 30, or preferably, is connected over at least a portion of the area at the interface between the insole 20 and the midsole 30, as shown in FIG. 3.

The outer side panel 18 has the outer bottom end 12 formed at the bottom of the upper 10 opposite the top end 14.

The inner surface of the outer bottom end 12 is coupled to the bottom side 32 of the midsole 30, and the outside surface of the outer bottom end 12 is coupled to the top 42 of the outsole 40. The outer bottom end 12 may be connected over the entire area of the interface between the midsole 30 and the outsole 40, or preferably, is connected over at least a portion of the area at the interface between the midsole 30 and the outsole 40, as shown in FIG. 3.

The upper 10 may comprise any conventional shoe upper material, such as a natural or synthetic leather, canvas, nylon mesh, neoprene, a breathable material, a stretchable or non-stretchable material, for example LYCRA® brand material, spandex, polyester, or nylon woven and/or knit textiles. Preferably, the upper 10 comprises a mesh and synthetic material to keep the shoe lightweight and to maximize breathability.

Closure system 19 may comprise any conventional shoe closure system, such as laces, ties, straps, VELCRO® brand hook and loop fasteners, belts and buckles, etc. Preferably, closure system 19 comprises a lace threaded through a plurality of holes located proximate the top end 14 of the upper 10.

The insole 20 further comprises a body 25 having a bottom surface, 21, a top surface 22, and an outer peripheral edge 24. The insole 20 is connected to either the inner bottom end 11 of the inner side panel 17 of the upper 10, or preferably, to a combination of the inner bottom end 11 and the topside 31 of the midsole 30. The insole 20 is sized to substantially cover the topside 31 of the midsole 30. In embodiments where the midsole 30 has side rims 36, the insole 20 fits substantially over the topside 31 within the side rims 36 of the midsole 30.

The insole 20 may comprise a fibrous cushioning material or a high hysteresis, low resilience, low memory material, such as a high hysteresis polyurethane foam or Ethyl Vinyl Acetate (EVA). The insole 20 may also comprise a foam cushion or tough artificial soling material, such as TEXON® or BONTEX® brand material. The insole 20 may further comprise an elastomeric polymer cloth that covers the entire topside of the midsole 30 to form a sock liner and to improve the appearance of the shoe 2. Indicia such as trademarks may be printed on the top surface 22 of the insole 20. A layer of latex foam may also be added to increase the cushioning effect of the shoe 2 thereby enhancing the comfort feature. In addition, the insole 20 may comprise an odor and/or moisture absorbing material, or may also comprise an insole 20 that has been impregnated with an antibacterial and/or antimicrobial agent.

The midsole 30 further comprises a body 33 having a topside 31, a bottom side 32, and a peripheral edge 34. The inner bottom end 11 of upper 10 is coupled to the topside 31 of midsole 30, preferably proximate to peripheral edge 34, and the outer bottom end 12 of upper 10 is coupled to the bottom side 32 of midsole 30, preferably proximate the peripheral edge 34 of the midsole 30.

Preferably, the midsole 30 further comprises an upwardly extending outer peripheral support side rims 36 having a wrap around construction. The side rims 36 are preferably constructed such that they are wider at the base of the side panels (where the side rims 36 connect to the body 33) than at the top. The inner bottom end 11 of upper 10 wraps around the inside of side rims 36 and the outer bottom end 12 of upper 10 wraps around the outside of side rim 36.

A plurality of recesses 37 may also be provided in the body 33 of midsole 30 to accommodate the inner bottom end 11 and the outer bottom end 12 of upper 10. Preferably, the recesses 37 are formed around the peripheral edge 34 on both the topside 31 and the bottom side 32 of the midsole 30 and extend inwards some distance toward a middle of the midsole 30 and have a depth sufficient to accommodate the thickness of the bottom ends 11, 12 of the upper 10.

The midsole may comprise any conventional cushioning material having properties of shock absorbsion, durability, flexibility, lightweight and resiliency, such as rubber, polyurethane, a suitable synthetic polymer material, or other suitable wear resistant soling material. The material of the midsole 30 should enhance the comfort and pliability of the shoe 2 for the wearer. In addition, a lightweight, semi-rigid material, such as EVA, may be used to construct the midsole. Preferably, the midsole 30 is constructed from a foam, such as EVA, polyurethane, or SPRINGLON® brand midsole compound. SPRINGLON® comprises a molded EVA that is modified by adding blown rubber to it.

The midsole 30 is also preferably comprised such that it has multiple or varying densities throughout the midsole 30 body 33. This plurality of densities aids in the manufacturing process and also increases comfort and cushioning effect of the shoe 2. For example, the periphery of the midsole 30 preferably has a high density than the interior portion of the midsole 30 so that the periphery is not crushed during the manufacturing process. Also, the heel section is preferably harder than the forefront section of the midsole 30 to increase the comfort and cushioning effect of the shoe 2.

The outsole 40 further comprises a base 41 having a top 42, a bottom 43, and upwardly extending sidewalls 44 located at a peripheral edge 45 of the base 41. The sidewalls 44 further have a wrap around construction about the base 41, thereby forming a cavity 46. The combination of the upper 10, the insole 20 and the midsole 30 is then disposed into and connected to the cavity 46 of outsole 40. More specifically, the outer surface of outer bottom ends 12 of upper 10, and the bottom side 32 and peripheral edge 34 of midsole 30 are coupled to cavity 46 of outsole 40.

The outsole comprises a resilient rubber-like material, such as a rubber, or polyurethane, or other suitable wear resistant soling material. The outsole is preferably made from a molded solid rubber material and includes treads 49 along the bottom 43 for traction and durability. Preferably the outsole covers the full length of the bottom of the shoe 2, however, the outsole 40 does not have to be the full length of the bottom of the shoe 2. The outsole 40 may comprise sections that cover limited areas of the shoe 2, such as the forefront and heel of the shoe 2, to reduce the weight of the shoe 2.

As shown in FIG. 3, the upper 10, insole 20, midsole 30, and outsole 40 combine to define a shoe housing 50 for receiving a foot (not shown), wherein the midsole 30 is enveloped and not exposed, and only the upper 10 and outsole 40 are exposed. This shoe design improves the fit and performance of the shoe 2 because the bottom ends 11, 12 of the upper 10 envelope at least the peripheral edge 34 (and side rims 36 if side panels are used) of midsole 30 thereby providing a more secure attachment of the shoe 2 and midsole 30 to a foot. Also, because the bottom ends 11, 12 of upper 10 wrap around the peripheral edge 34 of the midsole 30, the shoe 2 is pulled from the bottom and top as the laces 19 of the shoe 2 are tightened. This improves the performance and responsiveness of the shoe 2 by providing a better attachment of the shoe 2 to a foot.

Also disclosed is an exemplary method of shoe construction that comprises the steps of providing an upper 10, coupling an insole 20 to the upper 10, coupling a midsole 30 to the upper 10, and coupling an outsole 40 to the combination of the upper 10, insole 20, and outsole 40, so that the midsole 30 of the shoe 2 is enveloped and is pulled from the topside 31 and the bottom side 32 of the midsole 30 as the shoe 2 is tightened about a foot (not shown). This provides an improved attachment of the midsole 30 to the foot and an overall better fit of the shoe 2 to the foot.

The method of shoe construction for the shoe 2 of the present invention basically comprises two shoe structures in one. First, an inner "bootie" is formed comprising the inner side panel 17 of the upper 10 and the insole 20. The bootie is slip lasted and fitted over a last during assembly of the shoe 2. The midsole 30 is then coupled to this bootie and the outer side panel 18 of the upper 10 is coupled about at least a portion of the bottom side 32 of the midsole 30. Then the outsole 40 is lasted around the midsole 30.

More particularly, an exemplary method of the present invention comprises the steps of cutting an upper 10 piece from raw material. Preferably the raw material comprises a conventional breathable and wear resistant material. The upper 10 comprises an inner bottom end 11, an outer bottom end 12, a top end 14, a side panel 16, and a closure system 19 disposed proximate the top end 14 of the upper 10. The side panel further comprises an inner side panel 17 and an outer side panel 18 that are disposed between and connect the bottom ends 11, and 12 respectively, and the top end 14. The inner side panel 17 and the outer side panel 18 are pieced together and connected, preferably by stitching, proximate the top end 14, and form a wrap around design proximate the top end 14. This wrap around design forms a foot opening 15.

An insole is provided comprising a body 25 having a bottom surface, 21, a top surface 22, and an outer peripheral edge 24. The insole 20 is preferably constructed from a material having properties of cushioning, high hysteresis, low resilience, low memory, and tough artificial soling. The inside surface of the inner bottom end 11 is connected to the bottom surface 21 of the insole 20.

A midsole 30 is provided comprising a topside 31, a bottom side 32, and a peripheral edge 34. The midsole 30 is preferably constructed from a material having properties of shock absorbsion, durability, flexibility, lightweight, and resiliency. The outside surface of the inner bottom end 11 is connected to the topside 31 of the midsole 30. The inside surface of the outer bottom end 12 is connected to the bottom side 32 of the midsole 30.

An outsole 40 is provided comprising a base 41 having a top 42, a bottom 43, 30 and upwardly extending sidewalls 44 at a peripheral edge 45 of the base 41. The sidewalls 44 have a wraparound construction about the base 41 thereby forming a cavity 46. The outsole 40 is preferably constructed from a resilient, wear resistant, soling material that may include treads along the bottom 43. The combination of the upper 10, the insole 20, and the midsole 30 is then disposed into the cavity 46 and the outsole 40 is coupled to the combination of the upper 10, the insole 20, and the midsole 30 to form a shoe housing 50. The midsole 30 is enveloped by the upper, insole, and outsole and is not exposed. Only the upper 10 and the outsole 40 are exposed.

A preferred embodiment of the manufacturing process for the method of construction of the shoe of the present invention comprises the steps of:

Step 1: Raw material is die cut into the shape of the upper 10 and upper component parts;

Step 2: Die cut material is pieced together and stitched;

Step 3: Stitched upper 10 has insole 20 stitched to inside layer or inner bottom end 11 of upper 10;

Step 4: Molded heel counter is inserted into heel counter pocket;

Step 5: Finished upper 10 is placed on last;

Step 6: Prepared molded midsole 30 is attached and secured to lasted upper 10, preferably with cement. Preferably, the midsole 30 is prepared by first roughing the exterior areas that will be cemented. These areas are then primed with a chemical priming agent and allowed to dry. The midsole 30 is then painted with a heat activated urethane cement and allowed to dry. The midsole 30 is attached to the upper 10 by first heat activating the cement until it is tacky and applying it to the heat activated cemented surface of the outside of the inner bottom end 11 and the inside of the outer bottom end 12 at the bottom section of the lasted upper 10;

Step 7: The over hanging bottom end portions of the upper 10 surrounding the midsole 30 is stretched and wrapped around the midsole 30, preferably by means of a mechanical side lasting machine. Note, the midsole 30 preferably has two densities to prevent it from being crushed during this process. Preferably, the periphery of the midsole 30 has a higher density than the interior portion for this purpose. This allows the midsole 30 to be run through the manufacturing process yet not be to firm for wearing;

Step 8: The lasted upper 10 with midsole 30 attached and wrapped is prepared for sole laying by priming the areas where the outsole 40 will be attached. This is allowed to dry and a heat activated urethane cement is painted on this same area and allowed to dry;

Step 9: A prepared molded rubber midsole 30 (same procedure as described in step 6) is attached to the lasted upper 10 after the urethane cement is heat activated. It is attached to the areas of the upper 10 covered by heat activated urethane;

Step 10: The shoe 2 is allowed to cool off. This allows the urethane cement to cure. The finished shoe 2 has the last removed, has an optional footbed 28 inserted and shoe lace 19 added.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of making a shoe comprising the steps of:

providing an upper having an inner bottom end, an outer bottom end, a top end, a side panel disposed between and connecting said bottom ends and said top end, said side panel having an inner side panel and an outer side panel, and a closure system proximate said top end of said upper;

coupling an insole having a substantially flat body, a bottom surface, a top surface, and an outer peripheral edge to said inner bottom end of said upper;

coupling a midsole having a topside, a bottom side, and a peripheral edge to said upper and said insole combination by coupling said bottom side of said midsole to said outer bottom end and coupling said topside of said midsole to said inner bottom end of said upper;

coupling an outsole having a base, a peripheral edge, and an upwardly extending sidewalls at said peripheral edge of said base, wherein said sidewalls have a wraparound construction about said base thereby forming a cavity, to the combination of said upper, said insole, and said midsole to form a housing; and wherein said midsole is enveloped, and said midsole is pulled from bottom side and said topside by said closure system to secure said shoe to a foot.

2. The method of claim 1 wherein the step of coupling said insole to said inner bottom end of said upper further comprises stitching said outer peripheral edge of said insole to said inner bottom end of said upper.

3. The method of claim 1 wherein the step of coupling said bottom side of said midsole to said inner bottom end and coupling said topside of said midsole to said outer bottom end of said upper further comprises one of cementing, vulcanizing, bonding, sewing, glueing, welding, heat treatment, adhesively and flexibly bonded together.

4. The method of claim 1 wherein the step of coupling said outsole to the combination of said upper, said insole, and said midsole to form a housing further comprises one of cementing, vulcanizing, bonding, sewing, glueing, welding, heat treatment, adhesively and flexibly bonded together.

5. The method of claim 1 wherein the step of coupling said midsole to said upper further comprises the steps of preparing said midsole by first roughing the exterior areas that will be cemented, priming these areas with a chemical priming agent and allowing said chemical priming agent to dry, painting said prepared area with a heat activated urethane cement and allowing said cement to dry, attaching said prepared area of said midsole to said upper by first heat activating said cement until it is tacky and applying it to said heat activated cemented surface of the outside of said inner bottom end and the inside of said outer bottom end at the bottom section of said lasted upper.

6. The method of claim 1 wherein the step of coupling said midsole to said upper further comprises the steps of stretching said over hanging bottom end portions of said upper to surrounds said midsole, wrapping said stretched portions around said midsole by means of a mechanical side lasting machine.

* * * * *

UNITED STATES PATENT AND TRADEMARK OFFICE

CERTIFICATE OF CORRECTION

PATENT NO. : 6,256,824 B1
DATED : July 10, 2001
INVENTOR(S) : Austin et al.

It is certified that error appears in the above-identified patent and that said Letters Patent is hereby corrected as shown below:

Column 7,
Line 47, please delete line number "30".

Signed and Sealed this

Twelfth Day of March, 2002

*Attest:*

*Attesting Officer*

JAMES E. ROGAN
*Director of the United States Patent and Trademark Office*